US006932445B2

(12) United States Patent
Chiu

(10) Patent No.: US 6,932,445 B2
(45) Date of Patent: Aug. 23, 2005

(54) DRAWER INTERLOCKING MECHANISM

(75) Inventor: I-Hsiang Chiu, Ying Ghor (TW)

(73) Assignee: Nan Juen International Co., Ltd., Taipei (TW)

( * ) Notice: Subject to any disclaimer, the term of this patent is extended or adjusted under 35 U.S.C. 154(b) by 47 days.

(21) Appl. No.: 10/630,790

(22) Filed: Jul. 31, 2003

(65) Prior Publication Data

US 2005/0023941 A1 Feb. 3, 2005

(51) Int. Cl.[7] ..... E05C 7/06
(52) U.S. Cl. ..... 312/221; 312/222
(58) Field of Search ..... 312/217, 218, 312/219, 220, 221, 222

(56) References Cited

U.S. PATENT DOCUMENTS 4,889,396 A * 12/1989 Mitchell et al. ..... 312/221
4,966,423 A * 10/1990 Higuera et al. ..... 312/221
5,176,436 A * 1/1993 Mitchell ..... 312/221
5,352,030 A * 10/1994 Derle et al. ..... 312/221
6,238,024 B1 * 5/2001 Sawatzky ..... 312/221
6,254,205 B1 * 7/2001 Wright et al. ..... 312/217
6,568,771 B2 * 5/2003 Gentili et al. ..... 312/221
6,637,843 B2 * 10/2003 Westwinkel ..... 312/221

FOREIGN PATENT DOCUMENTS

DE 4004724 * 5/1991 ..... 312/218
GB 2170993 * 8/1986 ..... 312/221

* cited by examiner

*Primary Examiner*—Lanna Mai
*Assistant Examiner*—Hanh V. Tran
(74) *Attorney, Agent, or Firm*—Troxell Law Office, PLLC

(57) ABSTRACT

An improved drawer interlocking mechanism mainly has a number of curved holes at equal angle along the peripheral of an axle hole in the base. There are flexible and moveable sticking tabs along the peripheral of an axle cam, which is allowed to freely rotate when it is installed into the axle hole of a base. After the axle cam rotates by an angle, the tab matches and locks into a curved hole for positioning. Two sets of brakes have symmetrical matching stoppers on two opposite sides, so the brakes can be placed into any slot of the base and a guide groove can be placed on the axle line corresponding to convex point. The groove surface has a stop to block the convex point, so the brake can slide and lead the direction with position limiting function. Thus, this can prevent the brake from dropping out of the slot.

3 Claims, 10 Drawing Sheets

DRAWER INTERLOCKING MECHANISM

FIELD OF THE INVENTION

The present invention is related to an improved drawer interlocking mechanism, especially a simplified positioning mechanism for an axle cam and a brake to facilitate assembly.

BACKGROUND OF THE INVENTION

Presently, for the drawers lined vertically that can be open one at a time, FIG. 1 shows the interlocking mechanism 1 adopted to prevent other drawers from opening when one drawer is open.

As shown in FIG. 2, the traditional drawer interlocking mechanism 1' consists of a base 11', an axle cam 12' and two sets of brake 13'. The axle cam 12' relies on an axle 121' to locate and rotate in an axle hole 111' on a base 11', which allows a top convex 122' to rotate by 90 degrees when a guide groove 22' on a flip cover 21' is driven by a slider 2' to lock in or take off. As shown in FIG. 3 and FIG. 4, after the axle cam 12' rotates by 90 degrees, it is positioned by placing a steel ball 125' pushed by a spring 124' in a cylinder hole 123' at bottom into two grooves 31' on the sticking plate surface at the front of a rail 3'. Therefore, when the axle cam 12' rotates, it uses a guide groove 32' at the bottom convex 126' corresponding to the sticking plate at the front of a rail 3' to lead the rotation path. Achieving 90-degree rotation of the axle cam 12' relies on the axle 121', the spring 124', the steel ball 125' and the bottom convex 126'. Besides, the axle 121' needs nails to locate on the sticking plate surface at the front of the rail 3'. The required components are very complicated. Its manufacturing cost is high, so it does not provide economical benefit.

Please refer to FIG. 2 and FIG. 5. The above-mentioned two sets of brakes 13' are inserted in pair into a slot 112' of the base 11'. So both match to hold the axle cam 12'. Each has a sticking positioner 131' on one side. Thus, when the top convex 122' of the axle cam 12' takes off the guide groove 32' on the sticking surface at the front of the rail 3', it moves the two sets of brakes 13' outward. At the same time, the connected brake rod 4' locks the upper drawer and the lower drawer. On the other hand, when the guide groove 32' of the rail 3' is inserted again and drives the rotation of the top convex 122' of the axle cam 12', the opposite sides of the two sets of brake 13' move inward against each other. Thus, the connected brake rod 4' has available spacing to unlock the upper and lower drawers.

Because the above-mentioned brake 13' has a sticking positioner 131' on one side, which needs orientation prior to placement, it causes inconvenience for assembly. Further, the drawer interlocking mechanism 1' is installed on the slider 2' and the rail 3', so an integrated unit is formed and the two sets of brakes 13' fail to block the drawers effectively. Therefore, the brakes easily take off the base 11'. Especially the lower brake 13' is easier to drop off. Hence, the two sets of brakes 13' need separate assembly. It is complicated and time-consuming. Apparently, there is a need of improving the assembly process.

SUMMARY OF THE INVENTION

The inventor based on the need of a drawer interlocking mechanism improves the shortcomings of the above-mentioned drawer interlocking mechanism, so the axle cam design is simplified and components are easily assembled.

This invention can provide economic benefits by lowering manufacturing cost and assembly hours. The invention also helps increase product competitiveness for the industry, which is also the objective of the present invention.

DETAILED DESCRIPTION OF THE PREFERRED INVENTION

Figure 1:
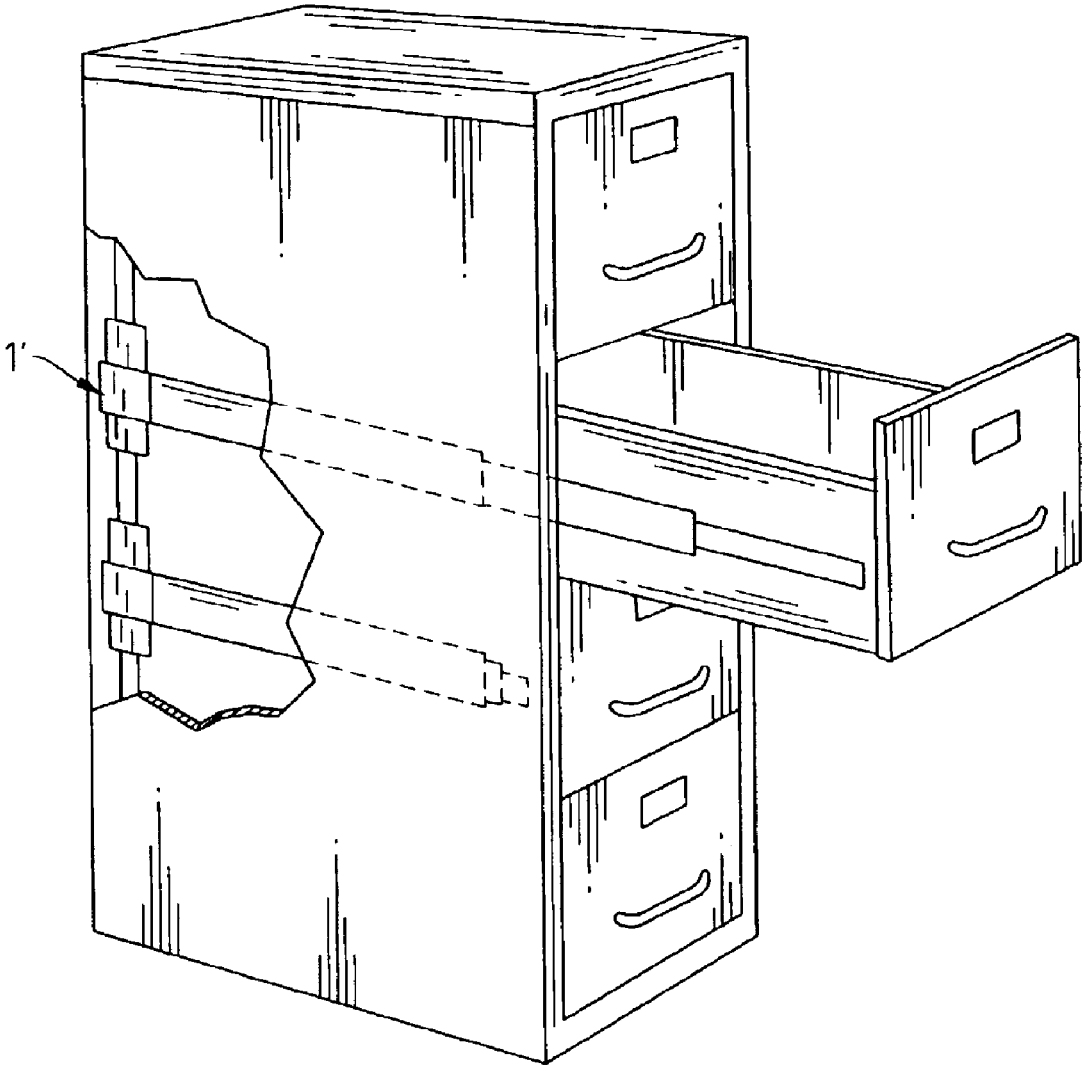
Fig. 1 Prior Art
FIG. 1 is the traditional drawer interlocking mechanism and an example of the assembly of the drawer, a rail and a slider.
Figure 2:
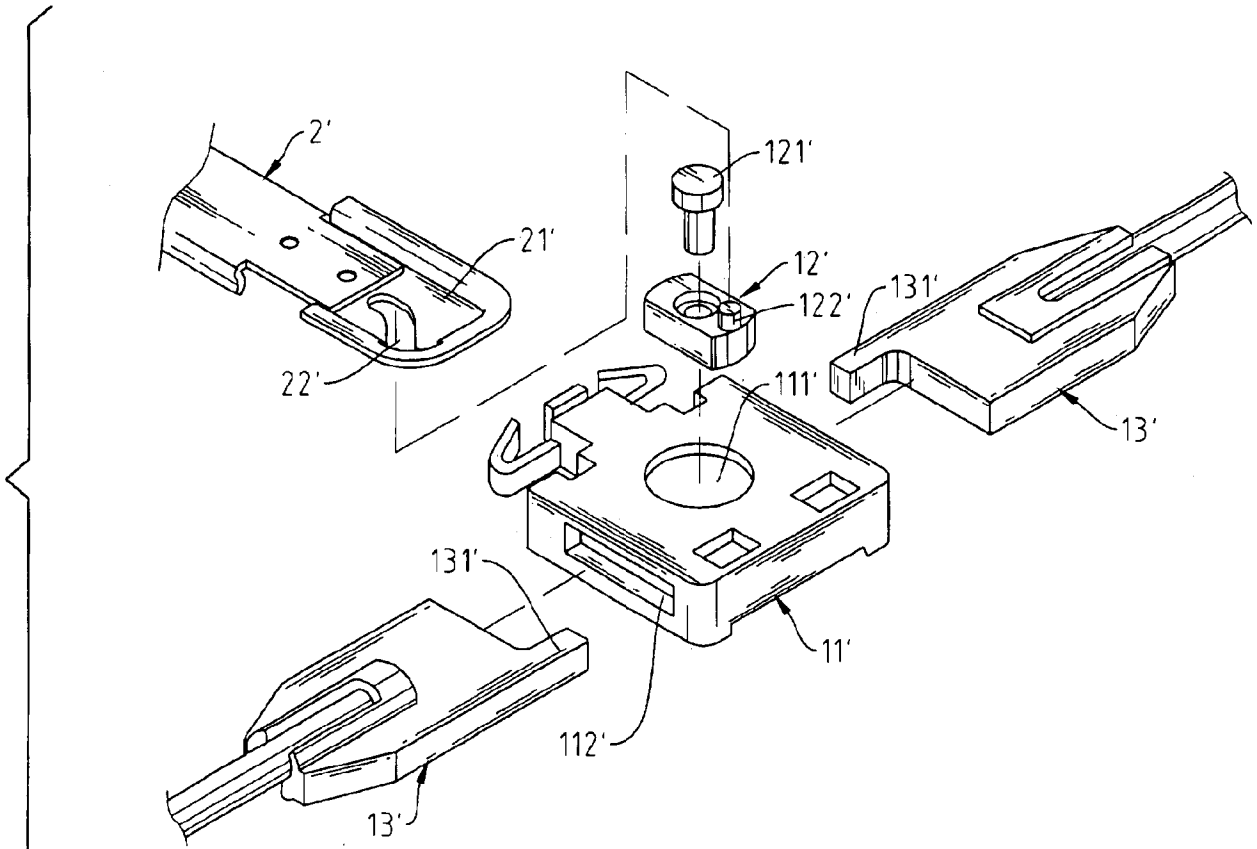
Fig. 2 Prior Art
FIG. 2 is the illustration of the components to assemble the traditional drawer interlocking mechanism.
Figure 3:
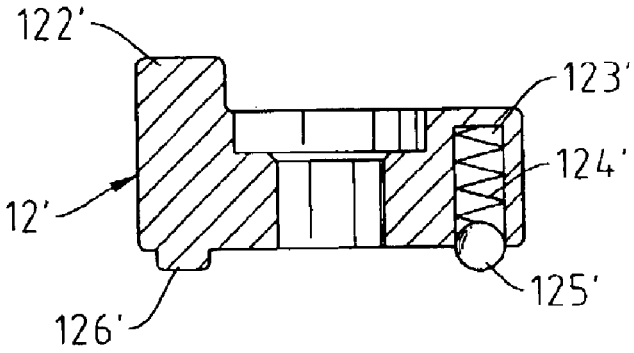
Fig. 3 Prior Art
FIG. 3 is the illustration for the locking mechanism of an axle cam of the traditional drawer interlocking mechanism.
Figure 4:
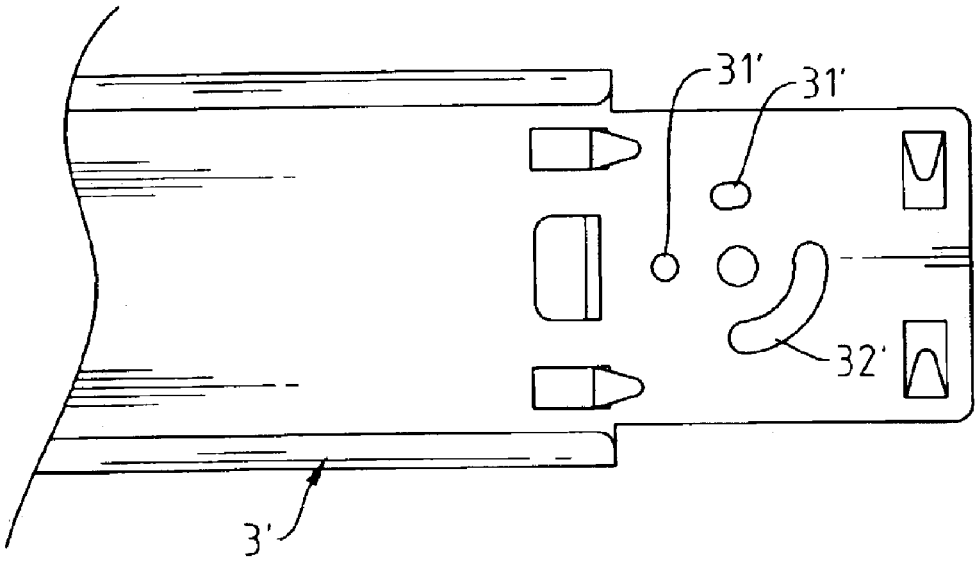
Fig. 4 Prior Art
FIG. 4 is the illustration for a cylinder hole design that consists of the front sticking plate of a rail and the related components.
Figure 5:
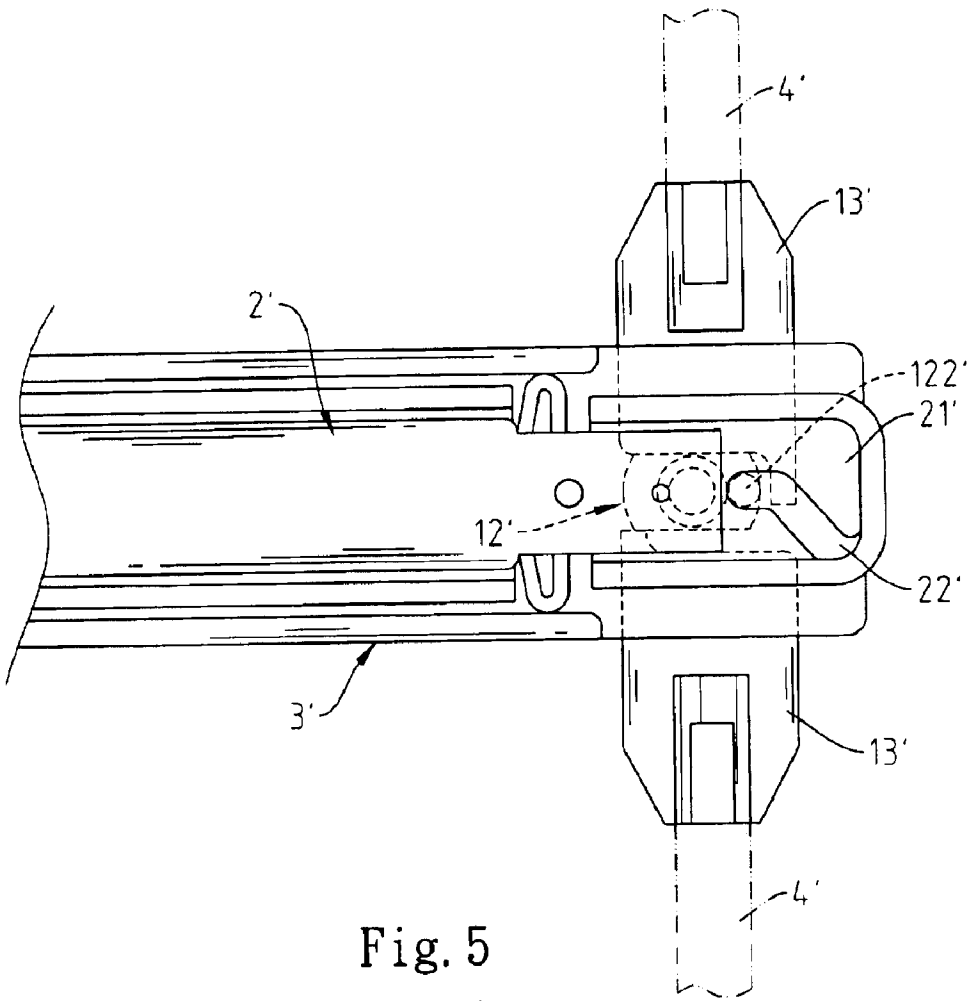
Fig. 5 Prior Art
FIG. 5 is a two-dimensional illustration for an assembly of an interlocking mechanism, a rail and a slider.
Figure 6:
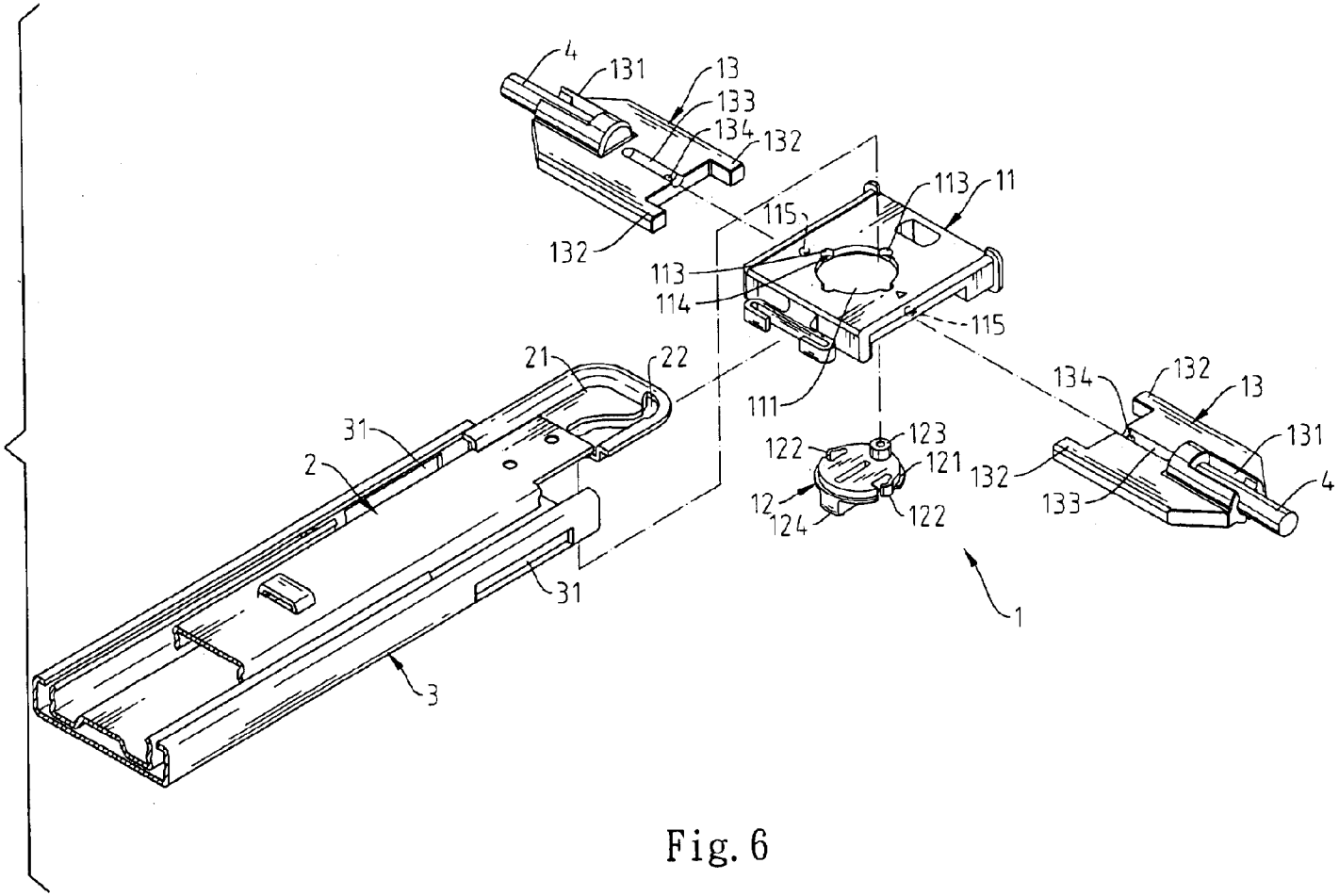
FIG. 6 the illustration for an assembly of the related components of the drawer interlocking mechanism.
Figure 7:
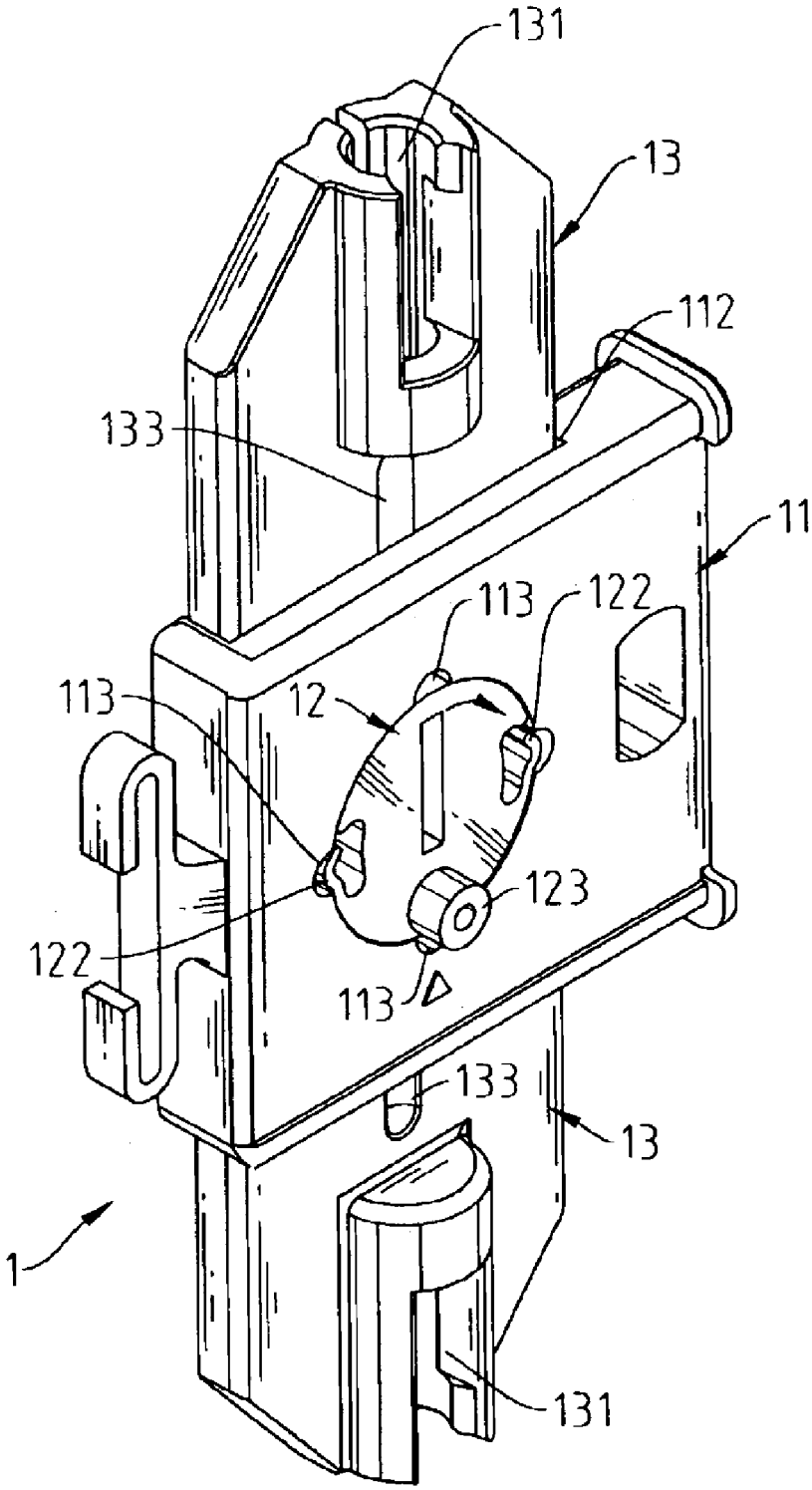
FIG. 7 is the status illustration for the rotating cam in the drawer interlocking mechanism.

Please refer to FIG. 6 to FIG. 11. The invention provides an improved drawer interlocking mechanism 1 that mainly consists of a base 11, an axle cam 12 and two sets of brakes 13.

The base 11 is fixed to one end of the rail 3. There is a penetrating axle hole 111 in the base 11 and a slot 112 on the side of the base 11. At the corresponding position on the rail 3 to the slot 112, there is a corresponding slot 31 with same openness. Along the peripheral of the axle hole 111, there are several curved holes 113 every 90 degrees. At the bottom, there is a ladder surface 114. Besides, on the two sides of the slot 112, which are symmetrical to the central line of the axle hole 111, there are sticking convex points 115.

The axle cam 12 has a sticking gradient edge surface 121 on outer edge for the slot 112 to place into the above-mentioned axle hole 111 of the base 11 and match the ladder surface 114. Thus, one side of the axle cam 12 can be blocked by the rail 3. The other side can be blocked by the ladder surface 114 of base 11. The axle cam 12 is maintained in the axle hole 111 for free rotation without dropping out. On each edge of the groove at the two sides of the axle cam 12, there is a flexible and moveable tab 122 and a sticking top column 123 on the intercepting side of the tab 122, which allows the guide groove 22 on the flip cover 21 of the slider 2 to insert or take off and block the axle cam 12 that rotates by 90 degrees (refer to FIG. 8 and FIG. 9) Each 90-degree rotation makes the tab 122 lock into the curved hole 113 and provides a locking mechanism for the axle cam 12 in the axle hole 111 after rotating by 90 degrees (refer to Figure). In addition, there is a sticking block 124 at the bottom of the axle cam 12.

When the axle cam 12 is compared to the traditional axle cam 12', it does not need to rely on the axle 121', the spring 124', the steel ball 125' and the bottom convex 126' to achieve 90-degree rotation, but needs only the locking mechanism comprising the sticking tab 122 on the peripheral and the curved hole 113 of the axle hole 111. This makes the locking mechanism design simplified. Besides, the traditional axle 121' needs nails to stay on the front sticking plate of the rail 3'. The axle cam 12 in the present invention does not need nails for locking, but only needs the rail 3 for blocking and the axle hole 111 for locking on a gradient surface. The new design has very simple assembly.

The two sets of brakes 13 in pair are inserted into the slots 112 of the base 11. The external grooves 131 can incorporate the brake rod 4 with a sticking stopper 132 on each side. Thus, the connection formed is symmetrically placed into the slot 112 of the base 11 in any direction. Therefore, it does not need to identify the placement direction and simplify the assembly process. Further, the block 124 of the axle cam 12 is allowed to rotate in the space between the two stoppers 132. The brake 13 is inserted into a guide groove 133 along an axle line at the convex point 115 corresponding to the slot 112, so the convex point 115 can be placed in the groove for sliding guide. Besides, on the surface of where the guide groove 133 is introduced, there is a sticking stop 134 to block the convex point 115. Thus, it provides a position-limiting effect on the guide groove 133 that is moving outward and the guide groove 133 will be prevented from dropping out of the slot 112. Such drawer interlocking mechanism 1 can be assembled onto the slider 2 and the rail 3 at a time, so an integrated framework can be directly installed on the drawer. Also there is no need to assemble the two sets of brakes 13 separately. It offers a simplified and quick assembly method.

Figure 8:
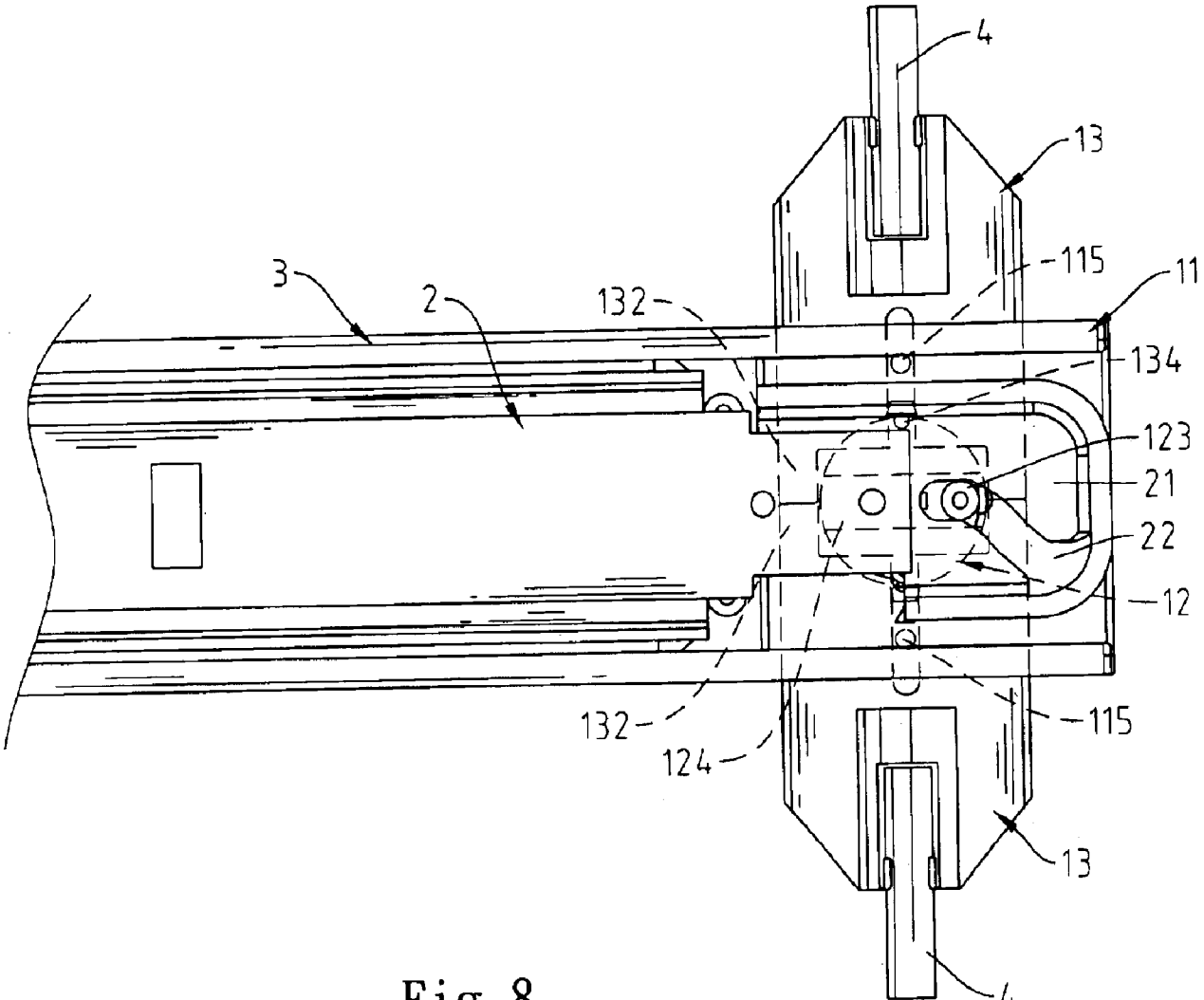
FIG. 8 is the illustration for the slider being pulled to drive the drawer interlocking mechanism.
Figure 9:
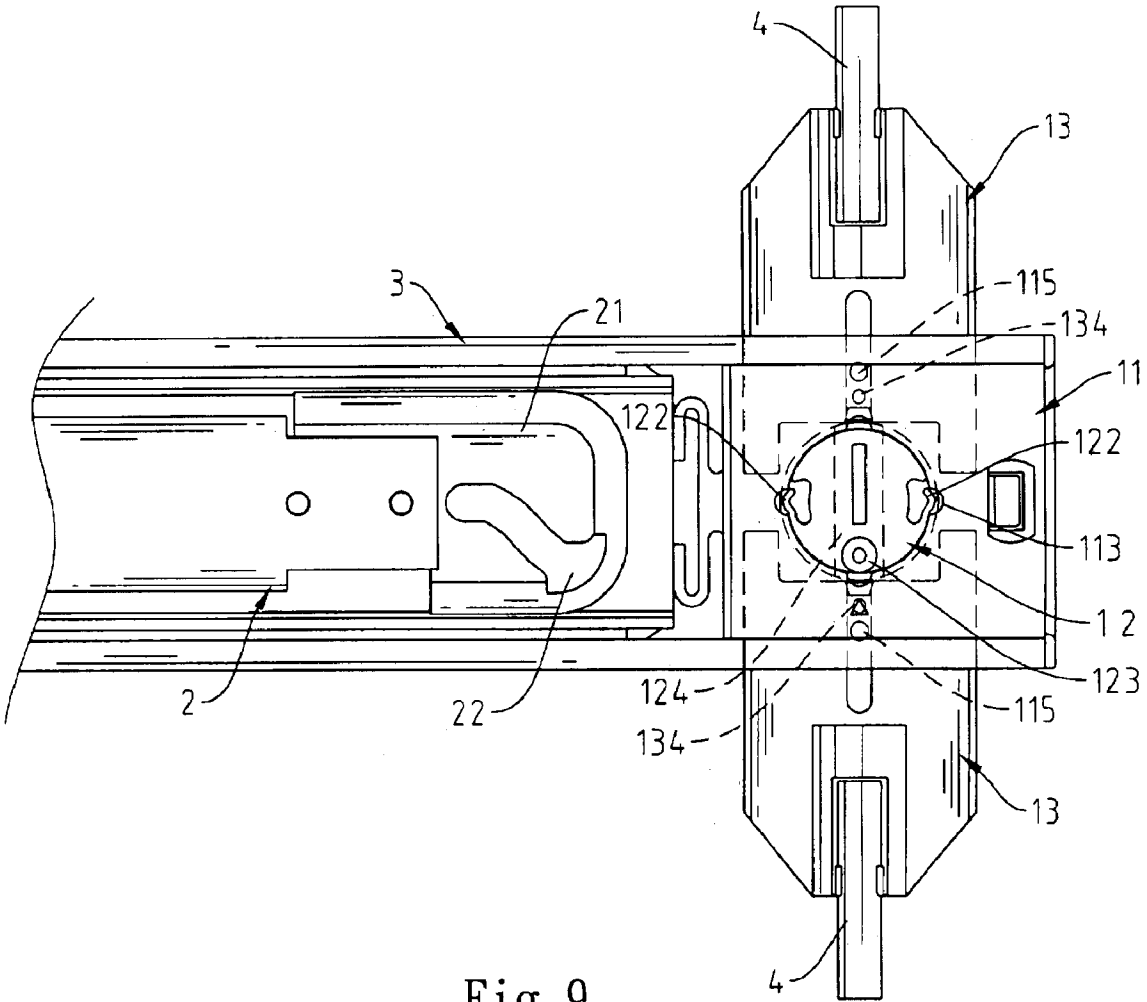
FIG. 9 is the illustration for the slider being pulled to drive the rotating axle cam.
Figure 10:
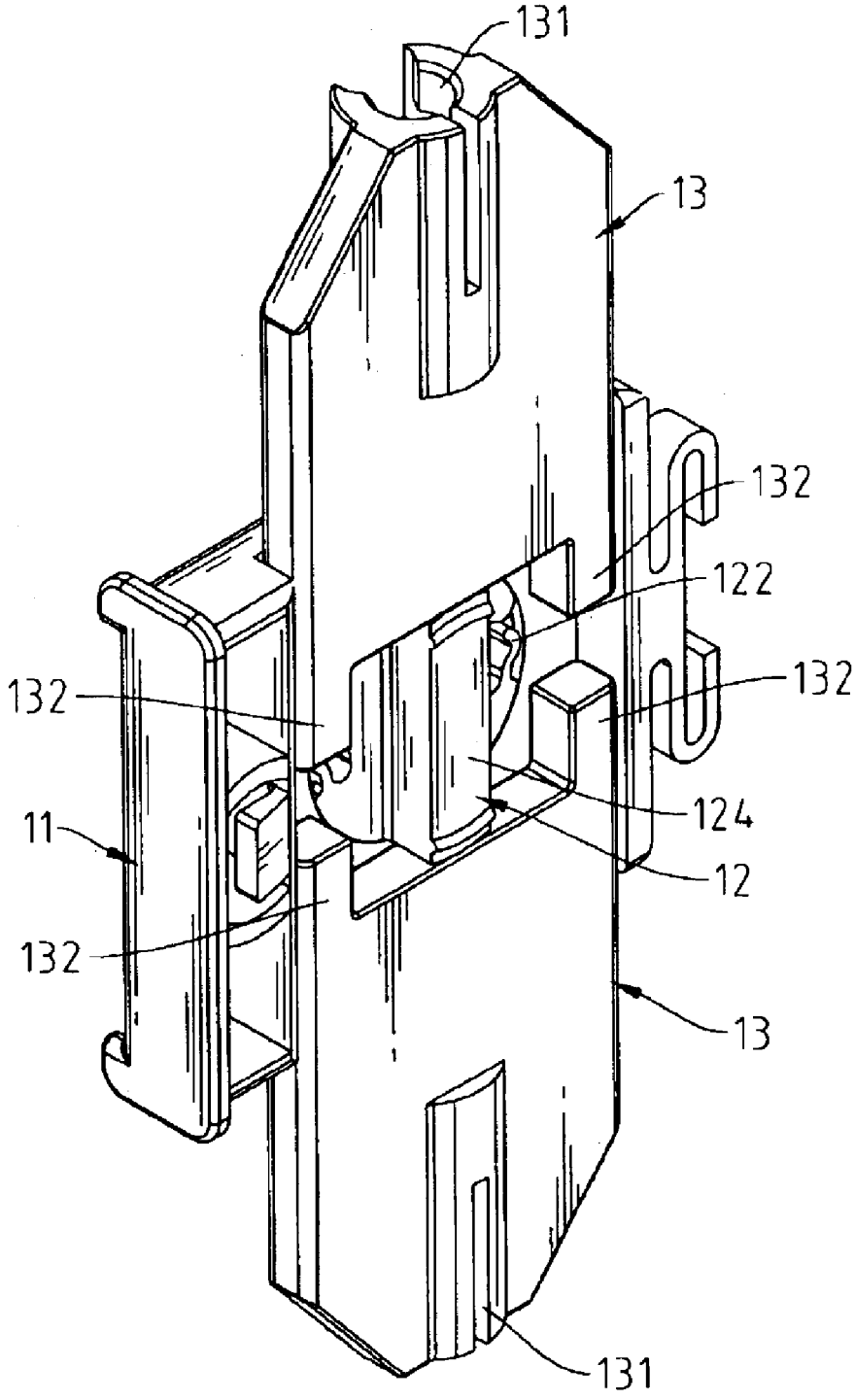
FIG. 10 is the illustration for the slider being pulled to move two sets of brakes.
Figure 11:
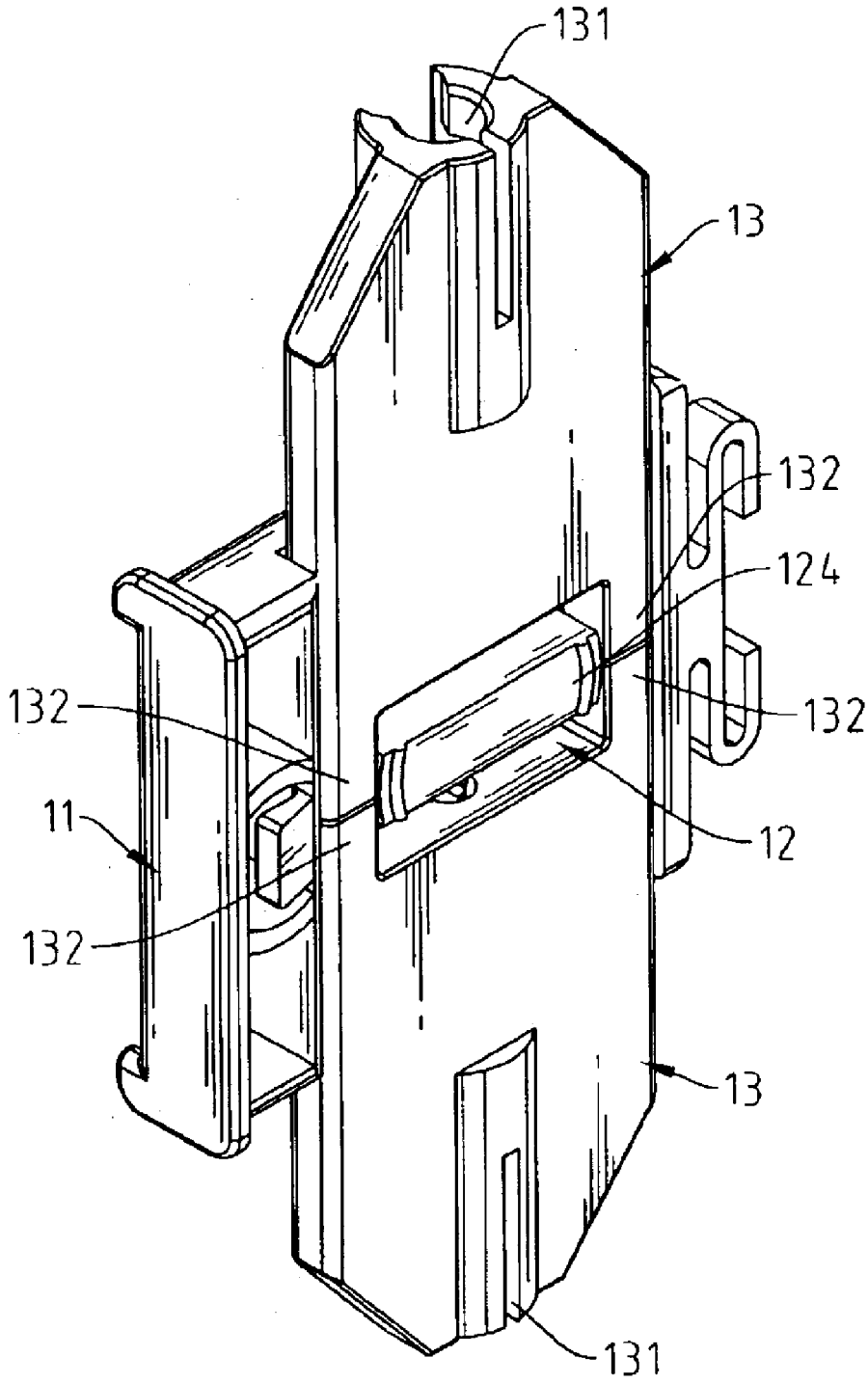
FIG. 11 is the illustration for the slider returning to the original position to drive the rotating axle cam and the two sets of brakes moving inwards.

From the above description for the present invention in a practical application, as shown in FIG. 8, it is known that when the top column 123 for the axle cam 12 is driven by the guide groove 22 on the sticking plate of the rail 3, the axle cam 12 can rotate 90 degrees and be positioned (refer to FIG. 9). The corresponding block 124 at the bottom of the axle cam 12 also rotates by 90 degrees and sets to a position. Now, the two sets of brakes 13 are pushed outward by the block 124, so the connected brake rod 4 can not move toward the two sets of brakes 13 (refer to FIG. 10). The brake rod 4 is blocked and the top and bottom drawers are locked. When the guide groove 22 for the rail 3 is inserted again to drive the rotation of the top column 123 of the axle cam 12. Thus, the block 124 at the bottom of the axle cam 12 rotates by 90 degrees and sets to a position. Immediately, the two ends of the two sets of brakes 13 have some space for the two brakes 13 to move inward against each other (refer to FIG. 11). The connected brake rod 4 also has shifting space that allows the top drawer or the bottom drawer unlocked.

As a result, the drawer interlocking mechanism in the present invention allows the rotation of the axle cam for positioning in a simplified design. Besides, the brake is modified to facilitate assembly. This greatly reduces manufacturing cost and assembly hours. It provides economic benefit and increases product competitiveness. The invention is a viable product with commercial value and progressiveness.

What is claimed is:

1. A drawer interlocking mechanism consisting of:

a base, an axle cam and two sets of brakes;

the base is connected to one end of a drawer rail and has an axle hole, along a periphery of the axle hole are a plurality of curved holes at an equal angle, and at a bottom of the axle hole is a gradient surface, the base has two slots for inserting the two sets of brakes and a sticking convex point on a central axle line of the axle hole of each of the two slots;

the axle cam has a sticking block on a bottom thereof and a sticking gradient edge surface located on an outer edge thereof, and a sticking flexible and moveable tab located on each of two opposing edges thereof, and a sticking top column on an intercepting side of the tab, the axle cam being rotatable in the axle hole, a drawer slide having a flip cover having guide groove, the top column being removably inserted into the guide groove, the guide groove controls the rotation of the top column, after rotation each tab matches and locks into one of the plurality of curved holes of the axle hole for positioning purpose; and one of the two sets of brakes is inserted into each of the two slots of the base, each of the two sets of brakes has two sticking stoppers, the two sticking stoppers are spaced apart to accommodate the block of the axle cam, each of the two sets of brakes has a brake guide groove having a sticking stop selectively engaging the sticking convex point of one of the two slots.

2. The drawer locking mechanism according to claim 1, wherein the rail has two corresponding slots aligning with each of the two slots of the base.

3. The drawer locking mechanism according to claim 1, wherein the axle cam is located between the gradient surface of the axle hole of the base and the rail.

* * * * *